US008910368B2

(12) United States Patent
Myodo et al.

(10) Patent No.: US 8,910,368 B2
(45) Date of Patent: Dec. 16, 2014

(54) IRON GOLF CLUB AND METHOD FOR MANUFACTURING THE SAME

(75) Inventors: Tomoyuki Myodo, Niigata (JP); Junichi Amano, Niigata (JP)

(73) Assignee: K.K. Endo Seisakusho, Tsubame-shi (JP)

( * ) Notice: Subject to any disclaimer, the term of this patent is extended or adjusted under 35 U.S.C. 154(b) by 416 days.

(21) Appl. No.: 13/028,704

(22) Filed: Feb. 16, 2011

(65) Prior Publication Data

US 2011/0201448 A1 Aug. 18, 2011

(30) Foreign Application Priority Data

Feb. 17, 2010 (JP) ..... 2010-032418

(51) Int. Cl.
*A63B 53/04* (2006.01)

(52) U.S. Cl.
CPC ..... *A63B 53/047* (2013.01); *A63B 2053/0445* (2013.01); *Y10S 148/903* (2013.01)
USPC ..... 29/557; 29/527.6; 148/525; 148/714; 148/903; 219/121.66; 72/342.94; 473/330

(58) Field of Classification Search
CPC ..... A63B 2053/0445
USPC ..... 29/575.5, 575.6, 527.6, 557; 219/121.66, 121.85, 121.64, 121.69, 219/121.6; 72/342.1, 342.94; 473/330, 331; 148/525, 529, 530, 565, 714, 902, 903
See application file for complete search history.

(56) References Cited

U.S. PATENT DOCUMENTS

| | | | | |
|---|---|---|---|---|
| 5,755,626 | A * | 5/1998 | Shira | 473/330 |
| 8,075,420 | B2 * | 12/2011 | Rick | 473/342 |
| 2002/0091014 | A1 * | 7/2002 | Aldrich | 473/324 |
| 2008/0017281 | A1 * | 1/2008 | Lin et al. | 148/525 |
| 2009/0143166 | A1 * | 6/2009 | Ban et al. | 473/331 |
| 2009/0325728 | A1 * | 12/2009 | Solheim et al. | 473/331 |

FOREIGN PATENT DOCUMENTS

| | | |
|---|---|---|
| JP | 2003-093560 A | 4/2003 |
| JP | 2003-199851 A | 7/2003 |
| JP | 2008-006296 A | 1/2008 |

* cited by examiner

*Primary Examiner* — Alexander P Taousakis
*Assistant Examiner* — Steven A Maynard
(74) *Attorney, Agent, or Firm* — Westerman, Hattori, Daniels & Adrian, LLP

(57) ABSTRACT

In order to sharpen and harden a corner portion of a score line edge portion of an iron golf club having a plurality of score lines on a face surface within a prescribed range, heat input is implemented on an edge portion of a groove through laser irradiation after the groove is machined and, as a result, the edge portion is hardened and melted to form a rounded corner R. The hardness is set at a Vickers hardness value (HV) of at least 350. The corner R forms a part of a contour line of the edge portion and this contour line is formed to exist between a first circle that contacts the face surface and a side surface of the groove and has a radius of 0.010 inches (0.254 millimeters) and a second circle that is concentric with the first circle and has a radius of 0.011 inches (0.2794 millimeters).

3 Claims, 6 Drawing Sheets

IRON GOLF CLUB AND METHOD FOR MANUFACTURING THE SAME

FIELD OF THE INVENTION

The present invention relates to an iron golf club having score lines on the face thereof and a method for manufacturing such an iron golf club, and more particularly to a method for manufacturing an iron club in which processing is implemented on the score lines of the iron golf club to improve striking effect and an iron golf club having such score lines.

BACKGROUND OF THE INVENTION

A plurality of grooves known as score lines are formed on a face of a golf club head. The score lines are used to apply spin to a ball when the ball is struck by the face during a shot and to stabilize the amount of spin, and therefore the shape and so on of the score lines affect an striking performance and a so-called spin performance. In the case of an iron in particular, an iron having a small loft angle (between 20 degrees and 30 degrees, for example) is referred to as a long iron while an iron having a large loft angle (between 40 degrees and 60 degrees, for example) is referred to as a short iron. Numbers and symbols such as 1, 2, 3, . . . , 9, PW (pitching wedge), and SW (sand wedge) are typically allocated to irons from a long iron to a short iron.

As regards short irons known as wedges having a loft angle between 45 degrees and 60 degrees, such as a PW (a pitching wedge), an AW (approach wedge) and a SW (sand wedge), from among the irons described above, those exhibiting a superior spin performance are preferred by professional players, advanced players and so on. The reason for this is that as the loft angle increases, a flying distance of the ball decreases, and therefore the player can aim for a target destination of the ball more easily with an iron having a large loft angle. In this case, though a target area becomes narrower, it is nevertheless more advantageous for a struck ball to stop close to its landing spot rather than to run excessively.

Further, in a professional game, greens are kept hard and set such that the ball rolls over them quickly and it is therefore particularly important to apply spin to the ball so that the ball stops close to its landing spot. Likewise with regard to long irons and middle irons, those with a high spin performance generate a stable amount of spin and are therefore desirable in terms of the flying distance. This is particularly important during shots from the rough to prevent flyers, which are balls that fly further than an intended flying distance because no spin is applied thereto.

Hence, a stable spin performance is required during iron shots made under various conditions. The shape of the score line greatly affects the stability of the spin performance. Specifically, sharpening an edge portion of the score line is effective in stabilizing the spin performance. Various methods for forming this type of score line have been proposed. For example, a manufacturing method, in which an edge portion of a score line is provided on a face surface by forming the score line on the face surface through pressing and then planing the face surface evenly through planar milling, has been proposed (see Japanese Patent Application Laid-open No. 2003-199851).

Further, a method for manufacturing a high quality golf club head with excellent manufacturing efficiency by modifying the shape of a score line groove to form a trapezoidal projection and then forging the projection has been proposed (see Japanese Patent Application Laid-open No. 2003-93560). In another known technique, explosion welding is applied to a site of the face surface relating to the score lines to form a component made of a hard, wear-resistant material, whereupon score line grooves are formed on the surface by machining. This document discloses a technique of forming an R portion of the groove by machining. A dimension of the R portion is preferably smaller than 0.01 inches (0.254 mm) (see Japanese Patent Application Laid-open No. 2008-6296).

The shape of the score line is subject to rules and, according to the R&A (Royal & Ancient Golf Club of St. Andrews; hereafter referred to as R&A) and the USGA (United States Golf Association; hereafter referred to as USGA), rules are defined as to the groove constituting the score line such that a rounded edge thereof must take a circular shape having a radius of no more than 0.020 inches (0.508 millimeters), the width thereof, when measured by a 30-degree measurement method (test on file with R&A), must be no more than 0.035 inches (0.9 millimeters), an interval between sides of adjacent grooves must be no less than three times the groove width and no less than 0.075 inches (1.905 millimeters), a depth thereof must be no more than 0.020 inches (0.508 millimeters) and so on.

Furthermore, according to new rules applied by the R&A and the USGA from Jan. 1, 2010 onward, the rounded edge of the score line groove on an iron golf club having a loft angle of 25 degrees or more must conform to a two circle rule, according to which the rounded edge of the score line groove is such that its configuration in cross section is within a range between a circle that is in contact with the face surface and the side surface of the groove with a radius of 0.010 inches (0.254 millimeters) and a circle with a radius of no more than 0.011 inches (0.2794 millimeters) and concentric with the first circle.

According to these rules, the score line is subject to the following restrictions: 1. The groove width must be no more than 0.9 millimeters (0.035 inches); 2. The interval between the sides of adjacent grooves must be no less than three times the groove width; 3. The interval between the sides of adjacent grooves must be no less than 1.9 millimeters (0.075 inches); 4. The groove width must be constant; and so on.

Thus, these new standards make conventional shapes and manufacturing methods completely obsolete, hence it is therefore necessary to provide a new manufacturing method that conforms to the shape according to the new standards. However, it is difficult to manufacture such a golf club head effectively and with stability using conventional techniques such as cutting or pressing. For example, cutting processing may be implemented using a cutting tool having a corner R that conforms to the new standards, but this tool becomes worn extremely quickly, leading to an increase in cost. Furthermore, it is difficult to create a stable shape with pressing. More specifically, when a conventional processing method is employed, an edge portion may sag excessively or protrude by approximately 0.01 to 0.15 mm on a face surface side, which must be corrected.

As another problem, there is concern that, because of the new rules, the spin performance may deteriorate when professional players, advanced players and so on make shots in a manner as they played in the past. Hence, such an iron golf club is required that maintains a superior spin performance within the scope of the new rules. The score lines, in addition to being limited in shape, are provided on the striking surface and therefore, when shots are made repeatedly, the edge portions become worn, causing the spin performance to deteriorate. Hence, resistance to wear caused by impacts is also required. Methods for manufacturing a club head using a hard material exist, but with such methods feeling in striking becomes hard, making it difficult to adjust the loft angle and a lie angle.

SUMMARY OF THE INVENTION

The present invention has been conceived under the circumstances of the related art described above and an object of the present invention is to solve the problems described above by providing a method for manufacturing an iron golf club with which score lines can be formed effectively and with stability in a shape that conforms to regulations, in particular with respect to a corner R of an edge portion of the score line. Another object of the present invention is to provide an iron golf club and a method for manufacturing thereof with which required sites, i.e. the edge portions of the score lines, are made wear-resistant so that a spin performance is less likely to deteriorate even after repeated striking and a superior hitting feel is obtained so that angle adjustment can be performed easily.

To achieve the objects described above, the present invention employs the following means.

The method for manufacturing an iron golf club according to the first invention is implemented on an iron golf club that includes: a head main body having a face, on which is formed on its front surface a plurality of grooves disposed so that a toe-heel direction corresponds to a lengthwise direction thereof, and having a shaft attachment portion provided on one side thereof; and a shaft connected to the shaft attachment portion, wherein heat input is implemented on an edge portion (18) of each of the grooves (15) facing a striking surface of the face (14) in order to melt the edge portion so that a corner R is formed, the corner R taken in a cross-sectional plane orthogonal to the face surface and the lengthwise direction of the grooves is set so that a contour line (19) of the edge portion of each of the grooves exists between a first circle (A) that contacts the face surface and a side surface of each of the grooves and has a radius of 0.010 inches (0.254 millimeters) and a second circle (B) that is concentric with the first circle and has a radius of 0.011 inches (0.2794 millimeters).

The method for manufacturing an iron golf club according to the second invention is a method for manufacturing an iron golf club according to the first invention, wherein the heat input is performed using one method selected from laser beam heating, arc plasma heating, electron beam heating, infrared heating and high-frequency heating, and the corner R is formed by heat generated during the heat input simultaneously with the heat input in which only the edge portion is irradiated.

The method for manufacturing an iron golf club according to the third invention is a method for manufacturing an iron golf club according to the first or second invention, wherein the face is made of a steel material, and the heat input hardens the edge portion to a Vickers hardness (HV) of at least 350.

An iron golf club according to the fourth invention is an iron golf club manufactured using the method for manufacturing a golf club according to any one of the first to third invention, wherein the heat input is performed partially on only the edge portion of each of the grooves and the edge portion has the corner R.

As described above, with the iron golf club and the method for manufacturing thereof according to the present invention, score line grooves are formed in a shape that conforms to regulations and possesses sharpness, and edge portions of the score lines are hardened. Hence, even under the new rules, a ball catches easily when struck so that spin amount remains stable during shots taken under various conditions and, as a result, spin effect can be enhanced.

DETAILED DESCRIPTION OF THE PREFERRED EMBODIMENTS

Figure 1:
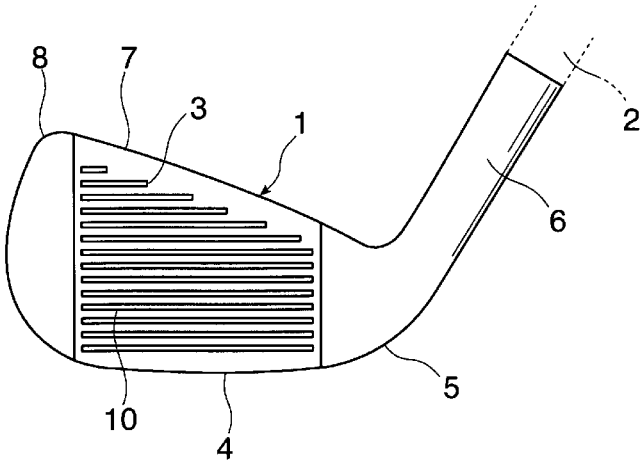
FIG. 1 is a front view of an iron golf club to which the present invention is applied.
Figure 2:
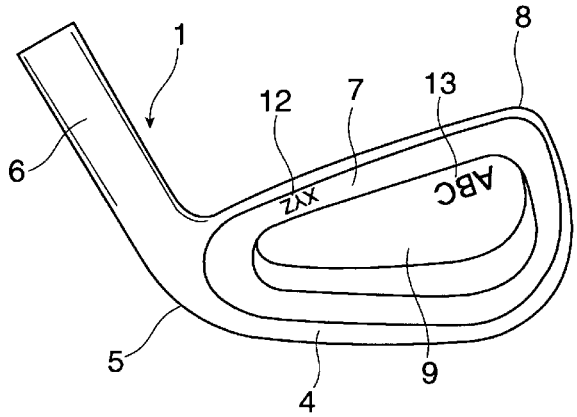
FIG. 2 is a back view of the iron golf club to which the present invention is applied.
Figure 3:
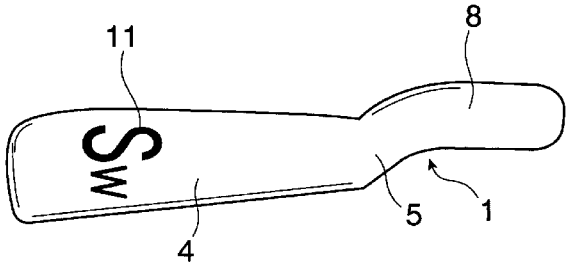
FIG. 3 is a bottom view of the iron golf club to which the present invention is applied.

An embodiment of the present invention will be described below with reference to the attached drawings, taking an iron type golf club head as an example. First, the constitution of an iron golf club serving as a basis of this embodiment will be described. As shown in FIGS. 1 to 3, a golf club is formed from a head 1 and a shaft 2. The head 1 is formed from a metal material such as low carbon steel, for example S20C, stainless steel or a titanium alloy. A face 3 serving as a ball striking surface is disposed on a front surface, a sole 4 is disposed in a lower portion and a heel 5 is disposed on one side of the head 1 respectively, while a shaft attachment portion 6 for connecting the head 1 to the shaft 2 is formed on an upper portion of the heel 5, a top 7 is formed in an upper portion of the head 1 and a toe 8 is formed on the other side of the head 1 respectively. A cavity 9 is formed in the back surface of the head 1 to substantially oppose the face 3. Note that the back surface of the head 1 may take a muscleback shape without a recessed portion, i.e. the cavity 9.

A plurality of score lines 10 constituted by rectilinear grooves are formed on the face 3 in a horizontal direction (in the drawing). A cross-sectional shape of the score lines 10 is a conventional V shape, U shape, trapezoidal shape or the like. The score lines 10 are formed as recessed portions on a surface of the face 3 by pressing using a die known as a line die, cutting or other machining. Further, a number display 11 is formed on the sole 4. The number display 11 is formed as a recessed portion on the surface of the sole 4 by pressing using a stamp. Furthermore, logo marks 12, 13 are formed respectively on the top 7 and the cavity 9 on the back surface of the head 1. The logo marks 12, 13 are likewise formed as recessed portions on a back surface side of the top 7 and a back surface side of the interior of the cavity 9, respectively, by pressing using stamps.

Figure 4:
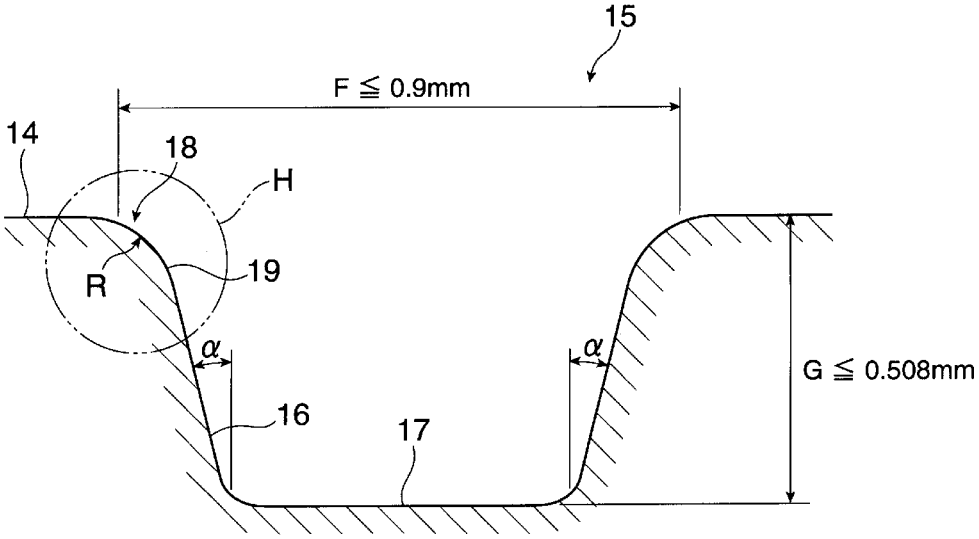
FIG. 4 is a partial sectional view showing a shape of a score line groove according to the present invention.

An external shape of the golf club to which the present invention is applied has been described above. Next, the structure of the grooves constituting the score lines 10 formed on a face surface 14 of the face 3 will be described in detail in an embodiment where the iron golf club is made of a steel material. FIG. 4 is a sectional view of a groove 15 (to be described below as a single groove), a plurality of which constitute score lines 10 cut into the face surface 14, showing an example of the groove 15 in partial sectional view taken in a plane orthogonal to a lengthwise direction of the face surface 14 and the groove 15. Note that although FIG. 4 shows a cross-section of a single groove 15, the other grooves 15 are similar. The groove 15 according to this embodiment is basically formed such that a width F thereof is no more than 0.035 inches (0.9 millimeters) and a depth G thereof is no more than 0.020 inches (0.508 millimeters). Further, the groove 15 is formed to be symmetrical about a groove center line.

Side walls 16 of the groove 15 are inclined surfaces that narrow in width toward a bottom surface 17. As regards the angle of the inclined surfaces, an opening angle (angle of inclination) $\alpha$ of one side surface is set to be 15 degrees in the embodiment shown in FIG. 4. An edge portion 18 of the face surface 14 takes a rounded shape (a rounded corner) conforming to the two circle rule, to be described below. The side wall 16 of the groove 15 forms a curved site having a contour line 19 that extends from the edge portion 18 to the side wall 16 of the groove 15 and the curved site is continuous from the side wall 16 of the groove 15 to the bottom surface 17 therebelow. The depth G of the groove 15 to the bottom surface 17 is dimensionally restricted to be no more than 0.508 millimeters from the face surface 14.

As described above, according to the new rules, restrictions are prescribed not only for the width F and the depth G described above but also for the roundness of the edge portion 18 of the face surface 14 and the side wall 16 of the groove 15, or in other words, the configuration of the contour line 19. In this embodiment, this roundness is formed to realize an improvement in a spin effect while conforming to, i.e. not contravening, the prescription of the new rules. This shape will be described specifically below.

Figure 5:
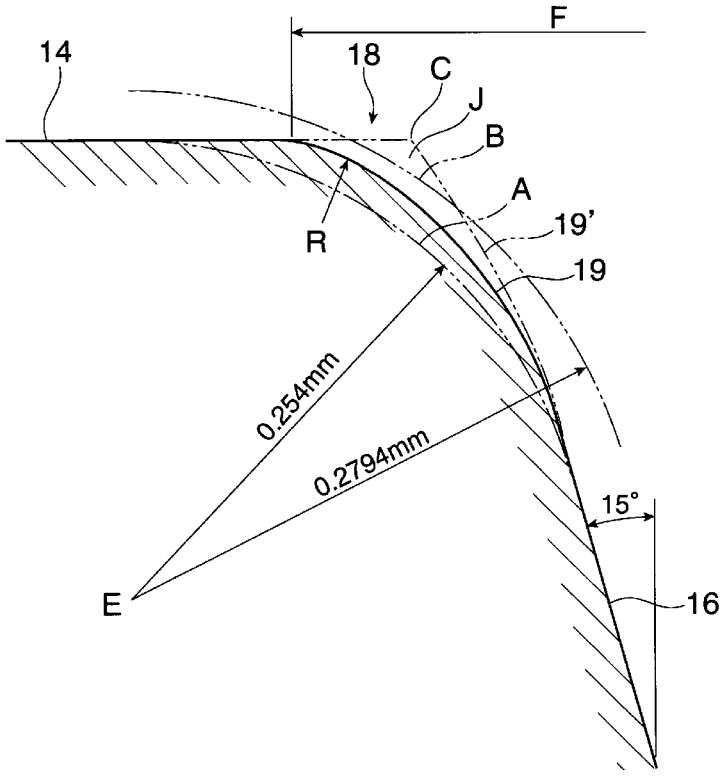
FIG. 5 is an enlarged illustrative view showing an portion H of FIG. 4.

FIG. 5 is an illustrative view showing an enlargement of an portion H in FIG. 4. This enlarged view shows the rounded edge portion 18 conforming to the two circle rule. In connection with the shape of the edge portion 18 of the face surface 14, a first circle A is an arc that is in contact with the face surface 14 and the side wall 16 and has a radius of 0.254 millimeters (0.010 inches). The first circle A is of a virtual arc set in order to specify the shape. A second circle B is of an arc having a center E identical to that of the first circle A and a radius of 0.2794 millimeters (0.011 inches). The second circle B is also indicated by a virtual arc. In this embodiment, the radius of the second circle B is set to be no more than the prescribed radius of 0.2794 millimeters. The edge portion 18 of the face surface 14 is formed as follows.

A point, at which a virtual contour line 19' exhibited before heat input through laser irradiation intersects the face surface 14, is set as a virtual point C. The virtual point C may be set in any position as long as it is in contact with the face surface. The virtual contour line 19' is a curve extending from the side wall 16 along the first circle A to the virtual point C. The portion in the vicinity of the virtual point C is deformed into the shape with the smoothly rounded contour line 19 by inputting heat through laser irradiation, as will be described below. As a result, the contour line 19 becomes a smooth curve provided between the first circle A and the second circle B. As shown in the drawing, the contour line 19 is a curve that exists between the first circle A and the second circle B and straddles the face surface 14 and the side wall 16.

Figure 6:
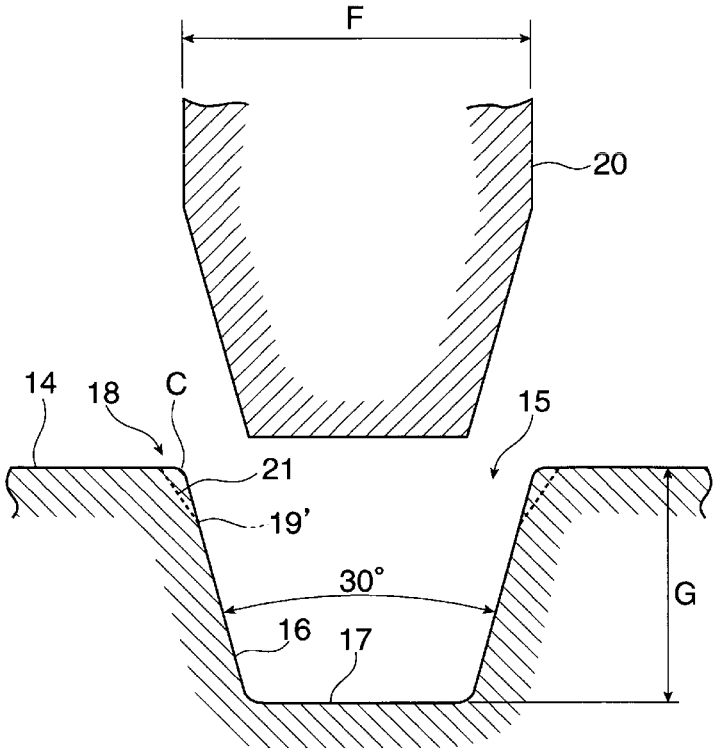
FIG. 6 is an illustrative view showing machining arrangement of the groove.

The shape of the edge portion 18 of the score line groove formed in the face surface 14 has been described above. Next, a method of forming this shape will be described. The score line takes a small shape and has small dimensions. In this embodiment, the shape is manufactured primarily by machining. FIG. 6 shows an arrangement of machining in which sites of the side wall 16, the bottom surface 17 and the contour line 19' are formed by cutting such as milling, grinding or form turning.

When milling is employed, the desired shape is formed by form milling, slotting or the like using a milling tool such as a slotting cutter shaped in alignment with the groove 15 of the score line 10. Similarly, when grinding is employed, a grinding tool such as a formed grindstone is used. As regards the shape (cross-sectional shape) obtained by this machining, the contour line 19 following heat input is shaped to exist between the first circle A and the second circle B and to extend smoothly from the side wall 16 to the point C on the face surface 14. In the example shown in FIG. 6, the side wall 16 and the contour line 19' are substantially rectilinear, but a contour line shape 21 extending outward of the groove 15 toward the face surface 14 from a midway point of the side wall 16 may be formed during the machining (see FIG. 6).

In other words, a tool 20 used in machining is so configured as to have the shape of the groove 15 made up of the side wall 16, the bottom surface 17 and the contour line 19. In this example, the tool 20 is a form cutter, which is a rotary tool or a cylindrical grindstone used in milling or grinding. If the groove 15 is subjected to pressing in advance, the tool 20 is used mainly as a finishing tool for finishing the site of the contour line 19. The contour line 19 terminates in the virtual point C on the face surface 14. Hence, the gap between the virtual points C on either side of the groove 15 corresponds to a tool width and therefore width machining can be performed precisely in accordance with regulations.

The virtual contour line 19' indicated by a virtual line in FIG. 6 denotes the shape obtained upon completion of the machining performed by the tool 20. As shown in FIG. 6, the sites of the side wall 16 and the virtual contour line 19' are rectilinear and therefore the groove width at the machining stage takes a smaller dimension than the groove width following heat input through laser irradiation. Alternatively, the contour line 19' may take a shape that is continuous with the side wall 16, i.e. a shape similar to the shape thereof at the heat input stage, as indicated by a dot-dot-dash line. In this case, energy capacity required for the laser irradiation used to input heat decreases, leading to a reduction in a deformation amount of the edge portion to be melted.

The tool 20 is positioned within the groove 15 and fed while being rotated, then moves over the face surface 14 in the lengthwise direction so that machining is implemented over the entire length of the score line 10 and, as a result, plurality of grooves 15 are formed. In the example shown in FIG. 6, if a site of the groove 15 on the periphery of the bottom surface 17 is pressed in advance, only the site of the contour line 19 need be machined by the tool 20, so that the site of the contour line 19 is machined to accurate dimensions.

In this case, the contour line 19 is a curve linking the virtual point C to the side wall 16. However, if the contour line 19' prior to heat input through laser irradiation is in a shape approximating a straight line extending from the side wall 16, it can occur that the virtual point C does not exist between the first circle A and the second circle B and, as a result, the final finished contour line 19 is not obtained. Next, a manner for forming the final finished contour line 19 will be described. As noted above, the contour line 19' obtained by machining alone is a virtual curve that impinges on the virtual point C and the virtual point C is angled, i.e. not rounded.

Next, processing is performed on the portion at the virtual point C to obtain a rounded shape and increased hardness. More specifically, heat input is implemented on the edge portion 18 through laser irradiation. By inputting heat, the edge portion 18 is partially melted and thereby rounded. When heat is input through laser irradiation in this manner, the portion in the vicinity of the virtual point C is melted into a liquid or semi-liquid form. Surface tension causes the protruded shape to be round. The rounded shape is then cooled to form an R shape. As a result, the acutely rounded smooth contour line 19 is formed from the face surface 14 to the side wall 16. In other words, the processed edge portion 18 is formed into a rounded shape such as that of the contour line 19 shown in FIG. 5 by melting the site in the vicinity J of the virtual point C.

The heat input through laser irradiation in this manner is capable of partially increasing the hardness in a desired position of a narrow portion. Moreover, the rounded portion can be hardened at the same time as the edge portion is rounded. As will be described below, the hardness of the rounded portion has a Vickers hardness value of at least HV 350 when the steel material in this example is used. Further, the processing of laser irradiation is an optimal method for accurately implementing heat input, since the conditions for the processing can be controlled easily. The virtual point C is disposed in the vicinity of the first circle A and the second circle B, and therefore, by melting and transforming into a rounded portion, the virtual point C comes to be disposed between the first circle A and the second circle B.

In order to melt and transform the portion in the vicinity of the virtual point C into a rounded shape so that the virtual point C is disposed between the first circle A and the second circle B, a laser irradiation condition must be set to be a constant output. In so doing, the final contour line 19 becomes a smooth curve that exists between the first circle A and the second circle B while straddling the face surface 14 and the side wall 16. The shape of the R portion of the curved site subjected to heat input through laser irradiation varies in accordance with the laser processing conditions, but as long as the R portion is formed to be between the first circle A and the second circle B, there are no limitations on the shape thereof. Hence, as long as the shape of the R portion prior to heat input and the laser processing conditions are constant, any shape may be used.

In this embodiment, the radius of the R portion is substantially 0.17 mm. As the radius of the R portion decreases, the sharpness thereof increases, leading to a corresponding improvement in spin effect. Hence, the radius of the R portion provided between the first circle A and the second circle B is ideally as small as possible. A radius of 0.17 mm is set within this range. After varying conditions in a number of ways, it was found that the radius of the R portion was between 0.16 mm and 0.25 mm (approximate values when the radius R is considered to be uniform), and all of these R portions were formed between the first circle A and the second circle B.

The processing conditions employed in this embodiment during heat input through laser irradiation were as follows: 1. Laser: YAG laser; 2. Output: 100 W continuous wave; 3. Speed: 1000 mm/minute; 4. Cooling and shielding: argon gas 100 L/minute; 5. Irradiation angle: 45-degree incline relative to the vertical direction. As noted above, the rounded part of the R portion can be hardened at the same time as the rounded portion has been formed. The hardness thereof is increased to a Vickers hardness of at least HV 350. The hardness was confirmed by examples. By increasing the hardness, variation in the shape of the R portion is reduced in comparison with a case in which hardening processing is not implemented, even when a large number of shots are played. As a result, striking stability is achieved. This result was corroborated by examples.

A case, in which machining is performed using a rotary tool and heat input is performed through laser irradiation, has been described above, but in another embodiment, the machining may be realized by shaping using a cutting tool. Further, the edge portion is set as a laser irradiation position, but in consideration of friction generated by the ball when struck, an irradiation direction is preferably set to include a part of the face surface. Hence, the site to be hardened corresponds to a position in which irradiation is performed from the face side. By machining and processing centered on the contour line 19 in this manner to obtain an accurate and stable shape or, in other words, by forming this site, which also serves as an end portion of the contour line, to be an acutely rounded shape while increasing the hardness thereof, the groove portion 15 is formed without sagging.

By forming the score line such that only the edge portion is hardened, a constitution, in which the surface is hard but the interior is soft relative to the surface, is obtained even though only a single material is used. Thus, a fine striking effect is generated and spin effect is enhanced with stability. As a result, the performance of the golf club is improved. An embodiment has been described above, but the present invention is not limited to this embodiment. In the above embodiment, heat input is performed through laser irradiation, but it is a matter of course that another method can be employed.

FIRST EXAMPLE

Figure 7:
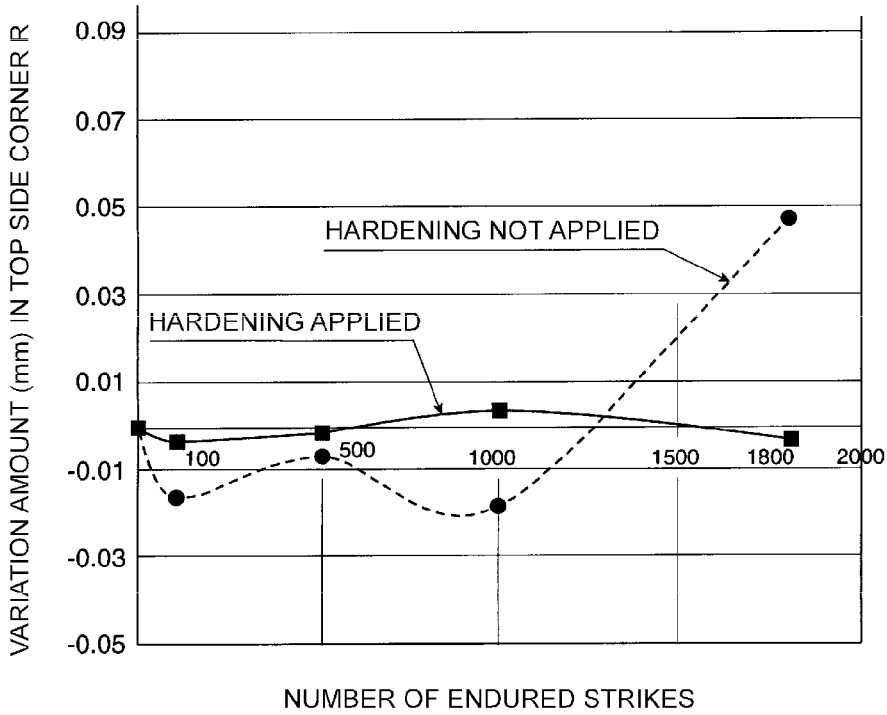
FIG. 7 is a data diagram showing results of a durability test performed on a groove R portion.

FIG. 7 is a data diagram showing results of a durability test performed on the edge portion of the score line. This diagram shows, for the face surface 14 formed from a steel material, comparison of a case in which heat input is performed with a case in which heat input is not performed. The data are obtained by repeatedly striking a ball on the score line 10 and determining variation of R in the R portion. Note that a single score line is formed with a top side edge portion and a sole side edge portion, but in consideration of the fact that the ball, when struck, moves over the face surface to the top side, the data refer to the R portion on the top side edge portion. When the R portion not subjected to heat input was compared to the R portion subjected to heat input, it was found that, in the former, the amount of variation therein began to differ greatly after only a small number of strikes and the amount of variation increased rapidly after 1,000 strikes. The R portion subjected to heat input was able to withstand a large number of strikes and the amount of variation therein was small and stable. It is therefore preferable to increase the hardness of at least the top side edge portion of the score line.

SECOND EXAMPLE

Figure 8:
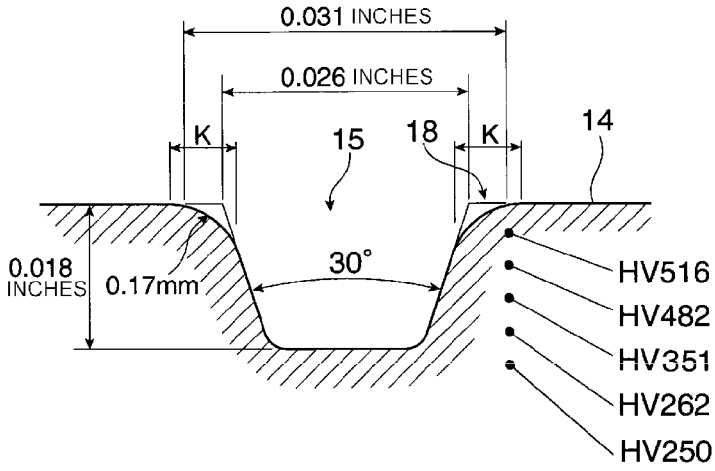
FIG. 8 is an example diagram showing hardness conditions of the groove R portion.

FIG. 8 shows in cross-section an example of hardness conditions obtained when heat was input to the edge portion of a score line formed in a steel material. The range of K shown in FIG. 8 is a heat input range. Heat input was performed on the face surface 14 side, whereupon the hardness corresponding to the depth in the edge portion was checked at five positions spaced apart each other by a substantially equal intervals along the distance to the groove bottom portion. The hardness in the edge portion was greater on the face surface side, where Vickers hardness values of HV 516, HV 482, HV 351, HV 262 and HV 250 were obtained toward the bottom surface side. In other words, it was confirmed that the rounded part had a Vickers hardness of at least HV 350. As regards the shape according to this example, configuration of a machined groove was such that an angle a on the side wall of the groove was 15 degrees on one side, the depth dimension of the groove was 0.018 inches and the width dimension of the groove was 0.026 inches. Following heat input through laser irradiation, the width dimension of the groove was 0.031 inches. The radius dimension of the face surface side R portion of the rounded part was 0.17 mm.

THIRD EXAMPLE

Figure 9:
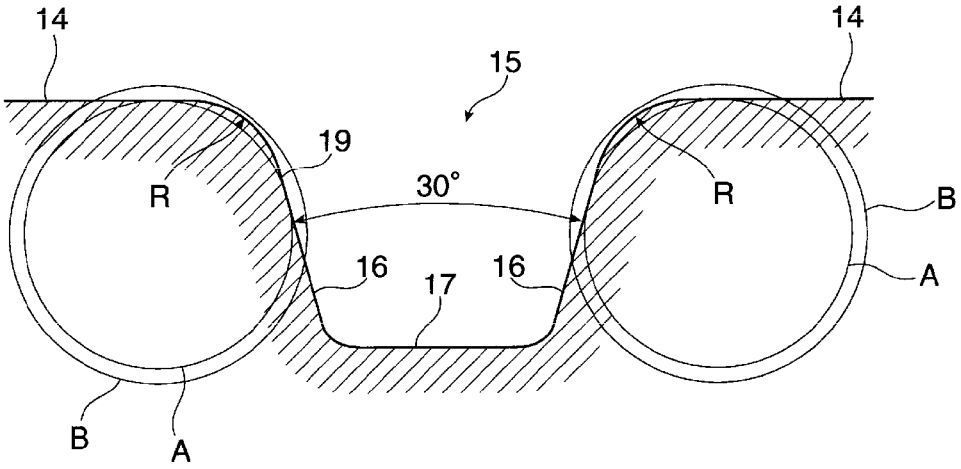
FIG. 9 is an enlarged sectional view showing an example of the shape of the groove R portion, in which a rounded portion is contained within two circles.

FIG. 9 is a partially enlarged view of the second example, showing the rounded part following heat input through laser irradiation. FIG. 9 shows that the rounded part was contained within two circles or, in other words, between the first circle A and the second circle B.

What is claimed is:

1. A method for manufacturing an iron golf club that includes a head main body having a face, on which is formed on its front surface a plurality of grooves disposed so that a toe-heel direction corresponds to a lengthwise direction thereof, and having a shaft attachment portion provided on one side thereof and a shaft connected to the shaft attachment portion, the method comprising:

forming the grooves such that each groove includes a bottom surface, a side wall, and a contour line connecting the side wall to the face surface;

implementing heat input on an edge portion of each of the grooves facing a striking surface of the face in order to melt the edge portion so that a comer is formed, wherein;

the heat input is implemented such that the corner taken in a cross-sectional plane orthogonal to the face surface and the lengthwise direction of the grooves is formed so that the contour line of the edge portion of each of the grooves is located between a first circle that contacts the face surface and a side surface of each of the grooves and has a radius of 0.010 inches (0.254 millimeters) and a second circle that is concentric with the first circle and has a radius of 0.011 inches (0.2794 millimeters);

the heat input is performed using laser beam heating;

the corner is formed by heat generated during the heat input simultaneously with the heat input in which only the edge portion is irradiated and the edge portion is melted into a liquid or semi-liquid, and by surface tension; and the contour line before the heat input was located outside of the region defined between the first circle and the second circle.

2. The method for manufacturing an iron golf club according to claim 1, wherein the face is made of a steel material, and the heat input hardens the edge portion to a Vickers hardness (HV) of at least 350.

3. An iron golf club, manufactured using the method for manufacturing an iron golf club according to claim 2;

wherein the heat input is performed partially on only the edge portion of each of the grooves and the edge portion has the corner.

* * * * *